US010172466B2

(12) United States Patent
DuVall

(10) Patent No.: US 10,172,466 B2
(45) Date of Patent: Jan. 8, 2019

(54) CHAIR WITH COVERING

(71) Applicant: Melissa DuVall, Republic, MO (US)

(72) Inventor: Melissa DuVall, Republic, MO (US)

( * ) Notice: Subject to any disclaimer, the term of this patent is extended or adjusted under 35 U.S.C. 154(b) by 27 days.

(21) Appl. No.: 15/336,308

(22) Filed: Oct. 27, 2016

(65) Prior Publication Data

US 2017/0112290 A1 Apr. 27, 2017

Related U.S. Application Data

(60) Provisional application No. 62/246,658, filed on Oct. 27, 2015.

(51) Int. Cl.
*A47C 7/66* (2006.01)
*A41D 3/08* (2006.01)

(52) U.S. Cl.
CPC ..... *A47C 7/66* (2013.01); *A41D 3/08* (2013.01); *A41D 2200/20* (2013.01)

(58) Field of Classification Search
CPC ..... A47C 7/66; A41D 3/08; A41D 2200/20
USPC ..... 297/184.1, 184.11, 188.03, 188.07, 297/188.06
See application file for complete search history.

(56) References Cited

U.S. PATENT DOCUMENTS 536,383 A * 3/1895 Huyck ..... A47G 9/066 2/69.5
2,712,133 A * 7/1955 Coleman ..... A61G 5/10 2/69
2,716,239 A * 8/1955 Barndollar ..... A41B 13/06 2/69.5
2,967,306 A * 1/1961 Fabanich ..... A41D 3/08 2/69.5
2,971,198 A * 2/1961 Tomich ..... A41D 3/08 2/84
3,258,781 A * 7/1966 Klein ..... A41D 3/08 2/88
3,522,612 A * 8/1970 Palmer ..... A41D 15/00 2/84
3,594,039 A 7/1971 Harp
3,798,676 A * 3/1974 Shanks ..... A41D 13/00 2/69.5
3,835,471 A * 9/1974 Lankford ..... A41D 3/08 2/84
3,837,006 A * 9/1974 Laseman ..... A41D 3/08 2/69.5

(Continued)

*Primary Examiner* — Rodney B White
(74) *Attorney, Agent, or Firm* — Global Intellectual Property Agency, LLC; Daniel Boudwin

(57) ABSTRACT

A chair with covering. The chair with covering includes a frame that supports a seat and a back support that forms a platform that supports a seated user. The frame includes at least one support leg that raises the seat from the ground. A garment is connected to the chair and is configured to move between a deployed position and a retracted position, wherein the garment is stored within a pocket in the retracted position. The pocket is affixed to the chair and includes an open upper end for receiving and for removing the garment. In the deployed position, the garment is configured to extend over the seat and the back support. In one use, the chair and garment provide protection from inclement weather when outdoors. In one embodiment, the pocket is affixable to the chair via adjustable strap that wraps around the back support.

8 Claims, 4 Drawing Sheets

(56) References Cited

U.S. PATENT DOCUMENTS 4,035,606 A * 7/1977 Browder ..... A47C 7/021 219/211
4,060,852 A * 12/1977 Meeks ..... A41D 15/04 2/84
4,142,264 A * 3/1979 Whiting ..... A47G 9/066 2/69.5
4,273,380 A 6/1981 Silvestri
4,370,755 A * 2/1983 Crumby ..... A41D 3/08 2/84
4,502,154 A * 3/1985 Itoi ..... A41D 3/00 2/108
4,752,971 A * 6/1988 Meserol ..... A41D 3/08 2/84
4,753,483 A * 6/1988 Beier ..... A47C 7/748 2/69.5
4,764,985 A * 8/1988 Wade ..... A41D 3/08 2/114
4,998,296 A * 3/1991 Stames ..... A41D 13/02 2/458
5,217,034 A * 6/1993 Yih ..... A45F 4/14 135/90
5,604,932 A * 2/1997 Lawicki ..... A47G 9/066 2/46
5,860,164 A * 1/1999 Johnson ..... A41D 15/04 2/108
5,875,492 A * 3/1999 Moss ..... A41D 3/08 2/82
5,884,331 A * 3/1999 Barajas ..... A41D 3/08 2/69
6,030,034 A 2/2000 Plohetski
6,272,683 B1 * 8/2001 Symms ..... A41B 13/06 2/69.5
6,353,933 B1 * 3/2002 Love ..... A41D 3/08 2/84
6,371,641 B1 * 4/2002 Wilson, Jr. ..... A45C 9/00 206/278
6,393,637 B1 * 5/2002 Hoffman ..... A41D 3/08 2/69.5
6,488,188 B2 * 12/2002 Fleischli ..... B63C 9/087 2/69.5
6,764,134 B1 * 7/2004 Crescenzi ..... A47C 31/00 2/69
6,851,127 B1 * 2/2005 Khan ..... A41D 13/00 2/84
7,003,825 B1 * 2/2006 Levings ..... A47G 9/066 2/69.5
7,458,104 B1 * 12/2008 Garcia ..... A41D 3/08 2/214
7,574,751 B2 * 8/2009 Barreiro ..... A41D 3/08 2/84
7,581,259 B2 * 9/2009 Thompson ..... A47G 9/066 2/69.5
7,802,844 B1 9/2010 Vencill
7,857,378 B2 12/2010 Smith
7,861,709 B2 * 1/2011 Kelly ..... A61F 7/02 126/204
8,079,099 B1 * 12/2011 Brown ..... A47G 9/066 2/69.5
8,464,374 B1 * 6/2013 Thayer ..... A47G 9/08 2/69
8,979,192 B2 * 3/2015 Miller ..... A47C 7/748 297/180.12
9,433,245 B2 * 9/2016 Elsmo ..... A47G 9/066
9,439,463 B1 * 9/2016 Spears ..... A41D 3/08
9,649,235 B1 * 5/2017 McComb-Jones ..... A61G 5/10
9,681,764 B1 * 6/2017 Boynton ..... A47G 9/066
9,763,485 B1 * 9/2017 Weitala ..... A41D 15/04
2003/0061659 A1 * 4/2003 Dunlap ..... A47G 9/066 5/485
2007/0061965 A1 * 3/2007 Crawford ..... A47G 9/066 5/413 R
2009/0039685 A1 * 2/2009 Zernov ..... A47C 7/66 297/16.2
2010/0078456 A1 * 4/2010 Mottram ..... A45C 11/00 224/576
2010/0146680 A1 * 6/2010 Cuoco ..... A41D 3/08 2/84
2011/0179548 A1 * 7/2011 Weston ..... A41D 3/02 2/84
2011/0258749 A1 * 10/2011 Hibbs ..... A41D 3/08 2/84
2012/0144550 A1 * 6/2012 Nejad ..... A41D 3/08 2/84
2012/0212019 A1 8/2012 Rodriguez et al.
2013/0328362 A1 * 12/2013 Miller ..... A47C 7/62 297/188.2

* cited by examiner

CHAIR WITH COVERING

CROSS REFERENCE TO RELATED APPLICATION

This application claims the benefit of U.S. Provisional Application No. 62/246,658 filed on Oct. 27, 2015. The above identified patent application is herein incorporated by reference a its entirety to provide continuity of disclosure.

BACKGROUND OF THE INVENTION

Field of the Invention

The present invention relates to a chair with garment covering. More specifically, the present invention provides a collapsible chair with a garment covering that extends from a pocket on the chair to cover a seated user.

Collapsible chairs are often used at outdoor events, such as picnics, sporting events, and the like. However, such chairs do not provide the user with storage and do not help to cover the person in the event there is inclement weather. As a result, the person may have to carry and hold a blanket or umbrella in addition to the collapsible chair. Thus, a collapsible chair having a pocket with an attached garment to protect the user from inclement weather is desired.

Devices have been disclosed in the known art that relate to chairs with blankets. These include devices that have been patented and published in patent application publications. These devices in the known art have several known drawbacks. For example, one of these known devices uses a chair having a removably mounted garment system. However, the garment system can be easily misplaced as it cannot be stored within a pocket of the chair then not in use.

In light of the devices disclosed in the known art, it is submitted that the present invention substantially diverges in de sign elements from the devices in the known art and consequent it is clear that there is a need in the art for an improvement to existing collapsible chair devices. In this regard the instant invention substantially fulfills these needs.

SUMMARY OF THE INVENTION

In view of the foregoing disadvantages inherent in the known types of chairs with coverings now present in the art, the present invention provides a new chair with covering wherein the same can be utilized for providing convenience for the user when seated outdoors in inclement weather.

It is therefore an object of the present invention to provide a new and improved chair with covering. The chair with covering comprises a seat and back support having a garment attached thereto. The garment is stored within a pocket disposed on the chair, and deployable over a seated user. The garment is preferably shaped as a poncho having a hood with a lace opening, a body portion configured to cover a body of a seated user, a pair of sleeves configured to receive arms of a seated user, and an open lower end configured to receive the legs of a seated user. The chair also includes a collapsible frame that supports the seat and back support, wherein the chair is easy to transport when in a collapsed configuration.

It is another object of the present invention to provide a chair with covering that allows a user with an easily accessible poncho-like garment that can be discretely stored when not in use.

Another object of the present invention is to provide a chair with covering that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
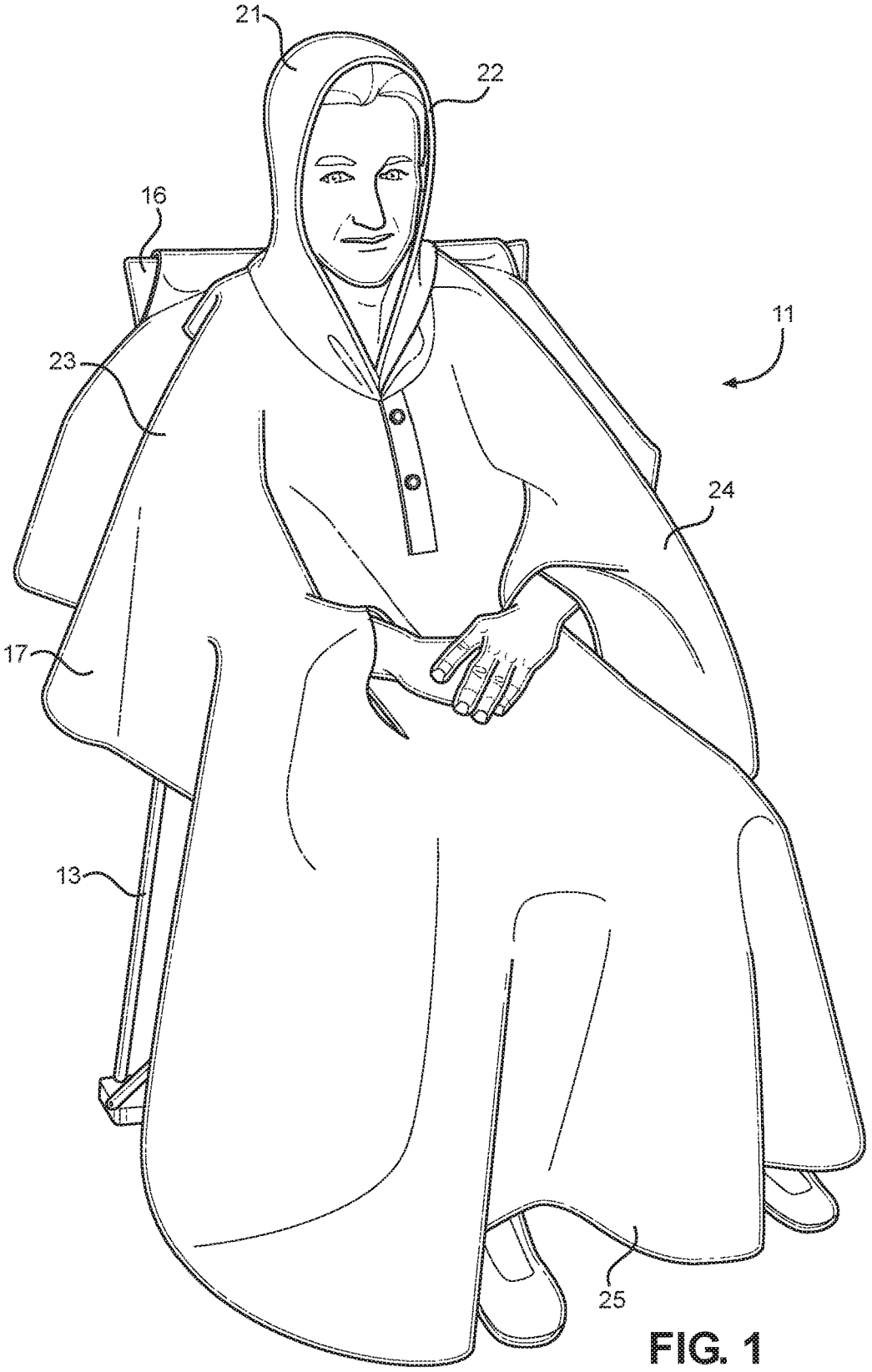
FIG. 1 shows a perspective view of the chair with covering in use.

Reference is made herein to the attached drawings. Like reference numerals are used throughout the drawings to depict like or similar elements of the chair with covering. For the purposes of presenting a brief and clear description of the present invention, the preferred embodiment will be discussed as used supporting a user in a seated position and covering a substantial portion of the user's body. The figures are intended for representative purposes only and should not be considered to be limiting in any respect.

Figure 2:
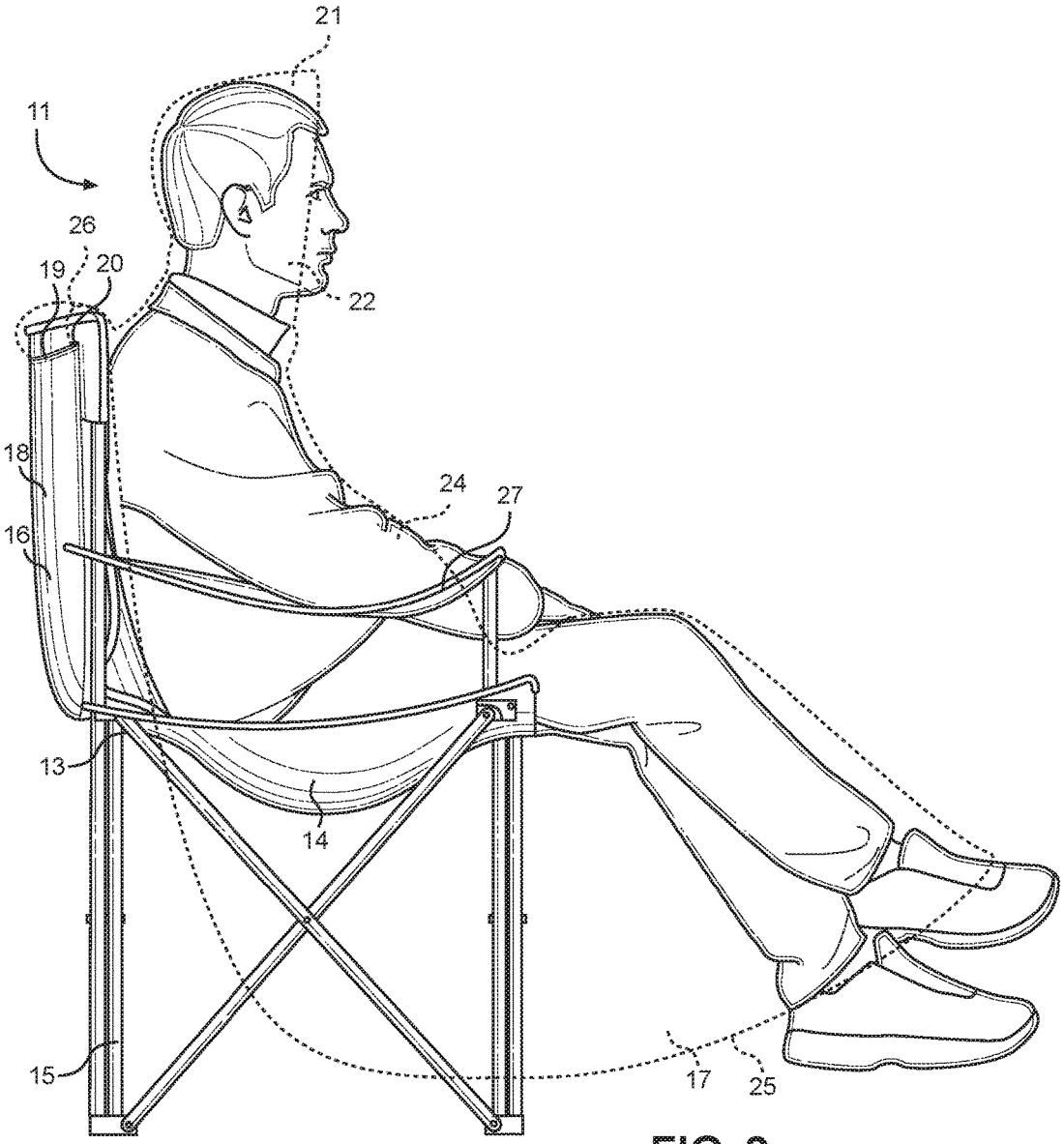
FIG. 2 shows a side view of the chair with covering in use.
Figure 3:
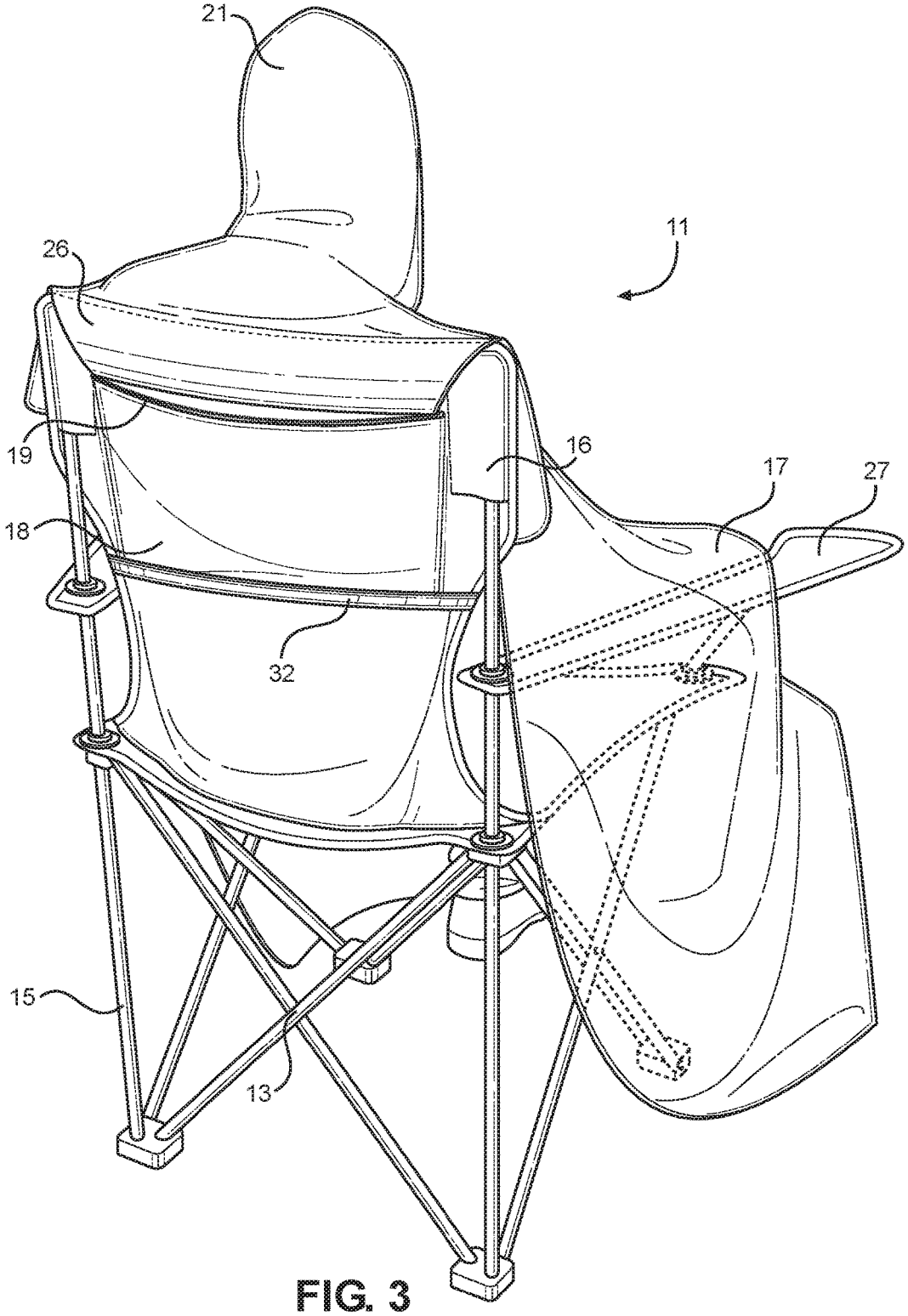
FIG. 3 shows a rear view of the chair with covering in use.

Referring to FIGS. 1-3, there is shown perspective, side, and rear view of the chair with covering use, respectively. The chair with covering 11 provides a seating device for supporting a seated user and a garment 17 that is selectively deployed from the chair 11 to cover the seated user. The chair with covering 11 comprises a seat 14 and a back support 16 supported by a frame 13 that dudes at least one support leg 15. In the illustrated embodiments, the frame 13 includes four support legs 15. The seat 14 and back support 16 are preferably composed of a flexible fabric. In the shown embodiments, the seat 14 and the back support 16 at affixed to the frame 13 which comprises a plurality of tubular rods interconnected at pivotal joints. In one embodiment, the chair 11 further includes a pair of armrests configured to support arms of a seated user.

Further, the chair with covering 11 is configured to move between an expanded position and a collapsed position via the flexible fabric seat 14, the back support 16, and frame 13. In an expanded position (as seen in FIG. 1-3) the seat 14 is oriented along a horizontal plane and the back support 16 is oriented along a vertical plane, wherein the seat 14 and the back support 16 are perpendicular to one another. In this way, the seat 14 supports a seated user and the back support 16 supports the back of the user. The frame 13 may be constructed from aluminum, and the seat 14 and back support 16 may be constructed from flexible, waterproof, lined material.

The chair with covering 11 further comprises a garment 17 configured to selectively move between a deployed position and a retracted position. In a retracted position, the garment 17 is stored within a pocket 18 disposed on the chair with covering 11. In the shown embodiments, the pocket 18 is disposed on the back support 16, wherein the open end 19 of the pocket 18 is oriented facing the upper end of the back support 16. The upper end of the back support 16 is positioned away from the seat 14 in an expanded position. In one embodiment, the open end 19 of the pocket 18 comprises a fastener 30, such as a zipper, for securely positioning the garment 17 within the pocket 18 in the retracted position. The pocket 18 is farther configured for removal or partial removal of the garment 17 in such a way that the garment 17 at least partially covers a seated user. In the deployed position, the garment 17 extends from the pocket 18 and preferably covers a seated user's head, torso, arms, and legs.

In one embodiment, the garment 17 comprises a poncho-like garment, wherein the garment 17 comprises a hood 21 with a face opening 22, a body portion 23 configured to cover a body of a seated user, a pair of sleeves 24 configured to receive the arms of a seated user, and an open lower end 25 configured to receive the legs of a seated user. In one embodiment, the garment 17 comprises fasteners 30 and closure mechanism such as buttons, hook and loop fasteners, and the like for assisting with the donning and wearing thereof. Further, the fasteners 30 are disposed on the body portion 23 along a centerline thereof for the opening and closing of the garment 17. The centerline is located between the pair of sleeves 24 of the garment 17. In one embodiment, the garment 17 includes pockets disposed along the interior thereof. These pockets are preferably positioned on e body portion 23 and aligned to receive both hands of a seated user when garment 17 is in the deployed position.

In one embodiment, the garment 17 may be partially secured to the pocket 18 so that the garment 17 cannot be fully separated therefrom. In alternate embodiments, the garment 17 may be fully removable from the pocket 18 so that it can be used separately from the chair 11. The garment 17 can be removably secured to the pocket 18 via a removable fastener, such as hook and loop fastening material, buttons, snaps, or other similar fasteners.

Specifically referring to FIG. 3, the pocket 18 is removably affixed to the back support 16 via a strap 32, wherein the strap 32 is configured to wrap around the back support 16. In the shown embodiment, the pocket 18 attached to the upper end of the back support 16 and extends about one third down the back support 16.

Figure 4:
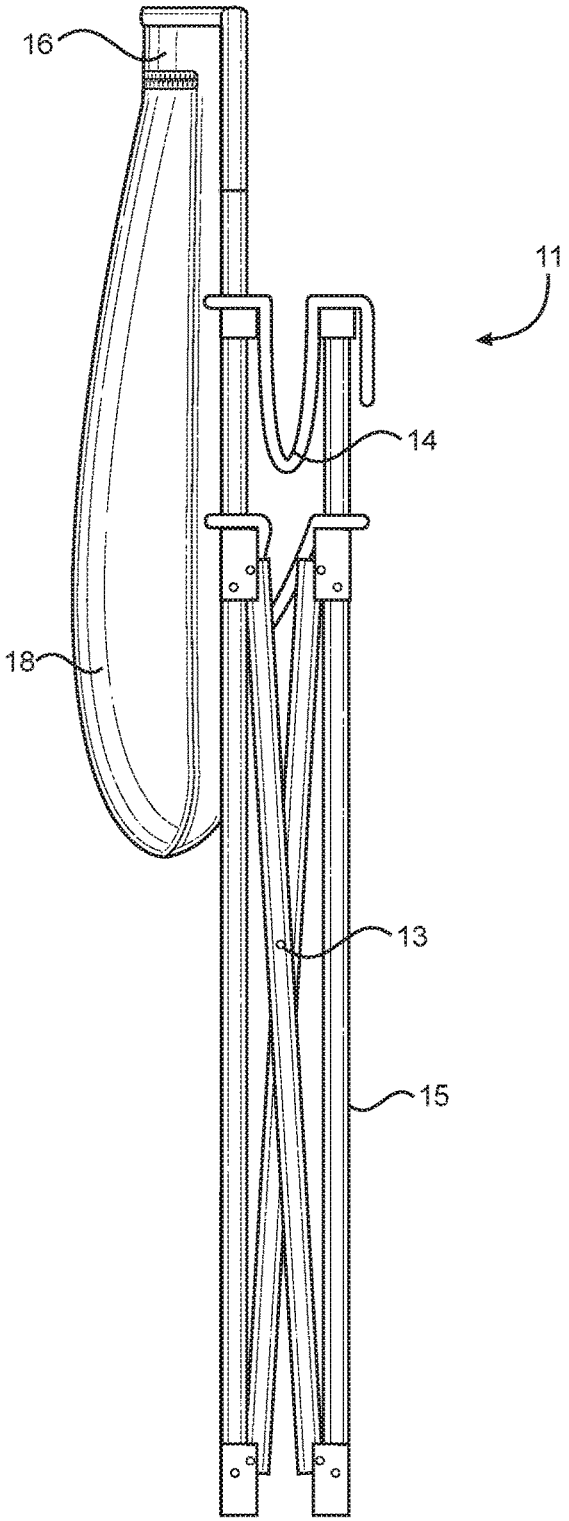
FIG. 4 shows a side view of the chair with covering in a collapsed position.

Referring to FIG. 4, there is shown a side of the chair with covering in a collapsed position. In operation, the user can expand the chair 11 so that the user can sit thereon while watching a sporting event or while engaging in another outdoor activity. The user can retrieve the garment 17 from the pocket 18 on the rear of the back support 16 in order to cover the user to protect the user from rain or other inclement weather. The garment 17 may be fully removable from the pocket 18 or may be partially affixed thereto so that the garment 17 cannot be entirely separated from the chair 11. In this way, the present invention provides a user with an easily accessible poncho that can be discretely stored when not in use.

It is therefore submitted that the instant invention has been shown and described in what is considered to be the most practical and preferred embodiments. It is recognized, however, that departures may be made within the scope of the invention and that obvious modifications will occur to a person skilled it the art. With respect to the above description there, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A chair with covering, comprising:

a chair including a frame that supports a seat and a back support, a garment configured to move between a deployed position and a retracted position;

a pocket affixed to the chair with an open upper end for receiving and for removing the garment therefrom;

a pocket fastener disposed at the open upper end of the pocket, the pocket fastener configured to open and close the pocket;

the garment affixed to an interior of a pocket, wherein in the retracted position the entire garment is stored within the pocket secured closed by the pocket fastener;

wherein the garment is configured to extend from the open upper end and extend over the back support and cover an occupant in the chair when in the deployed position.

2. The chair with covering of claim 1, wherein:

the garment is a poncho comprising a hood with a face opening, a body portion configured to cover a body of a seated user, a pair of sleeves configured to receive arms of a seated user, and an open lower end configured to receive the legs of a seated user.

3. The chair with covering of claim 2, wherein:

the body portion includes fasteners along a centerline for opening and closing of the garment.

4. The chair with covering of claim 1, further comprising:

a pair of armrests configured to support arms of a seated user.

5. The chair with covering of claim 1, wherein:

at least one support leg engages a second support leg so as to move the chair between an expanded configuration and a collapsed configuration.

6. The chair with covering of claim 1, wherein:

the pocket is removably affixed to the back support via a strap, wherein the strap is configured to wrap around the back support.

7. The chair with covering of claim 1, wherein the open upper end of the pocket is disposed at a distance from an upper end of the back support of at least less than one-third of a height of the back support.

8. The chair with covering of claim 1, wherein the garment breaks away from the interior of the pocket, thereby allowing separability and preventing injury.

* * * * *